US008096929B2

(12) United States Patent
Habing et al.

(10) Patent No.: US 8,096,929 B2
(45) Date of Patent: Jan. 17, 2012

(54) ABDOMINAL EXERCISE STATION

(75) Inventors: Theodore G. Habing, Tustin, CA (US); Douglas J. Habing, Long Beach, CA (US)

(73) Assignee: Dream Visions, LLC, Tustin, CA (US)

( * ) Notice: Subject to any disclaimer, the term of this patent is extended or adjusted under 35 U.S.C. 154(b) by 1098 days.

(21) Appl. No.: 11/372,645

(22) Filed: Mar. 10, 2006

(65) Prior Publication Data

US 2007/0213184 A1 Sep. 13, 2007

(51) Int. Cl.
*A63B 71/00* (2006.01)
*A63B 21/00* (2006.01)
*A63B 23/025* (2006.01)

(52) U.S. Cl. ..... 482/139; 482/92; 482/93; 482/10

(58) Field of Classification Search ..... 482/94, 482/140, 142, 92, 100, 98, 99
See application file for complete search history.

(56) References Cited

U.S. PATENT DOCUMENTS

| | | | | |
|---|---|---|---|---|
| 4,372,553 | A | 2/1983 | Hatfield | |
| 4,826,157 | A * | 5/1989 | Fitzpatrick | 482/133 |
| 4,915,377 | A * | 4/1990 | Malnke et al. | 482/98 |
| 5,056,779 | A * | 10/1991 | Webb | 482/137 |
| 5,094,449 | A * | 3/1992 | Stearns | 482/130 |
| 5,669,865 | A * | 9/1997 | Gordon | 482/142 |
| 5,769,766 | A * | 6/1998 | Huang | 482/140 |
| 5,938,575 | A * | 8/1999 | Stearns | 482/140 |
| 6,186,926 | B1 * | 2/2001 | Ellis | 482/97 |
| 6,659,919 | B2 * | 12/2003 | Deola | 482/99 |
| 6,896,643 | B2 * | 5/2005 | Durfee, Jr. | 482/100 |
| 7,220,221 | B2 * | 5/2007 | Mosimann et al. | 482/100 |
| 2002/0065174 | A1 * | 5/2002 | Chen | 482/72 |
| 2002/0098957 | A1 * | 7/2002 | Webber | 482/138 |
| 2005/0096198 | A1 * | 5/2005 | Webber et al. | 482/97 |
| 2005/0272573 | A1 * | 12/2005 | Carter | 482/99 |

* cited by examiner

*Primary Examiner* — Loan Thanh
*Assistant Examiner* — Sandhara Ganesan
(74) *Attorney, Agent, or Firm* — Blakely Sokoloff Taylor & Zafman LLP

(57) ABSTRACT

A multi-station exercise apparatus includes a station for performing abdominal exercises. The abdominal exercise station is combined with another exercise station, such as a press exercise station, a high pulley station or a leg extension/leg curl station. The apparatus for performing an abdominal exercise includes a pad for the head and/or neck of the exerciser that is pivotally connected to the frame of the exercise machine. A pair of hand grips are connected to the head/neck pad and disposed so that the exerciser may grasp the hand grips in order to pull forward in a "crunch" exercise. Exercise resistance is provided by means such as a weight stack that is shared by the various stations of the exercise machine. The head/neck pad may be "docked" when not performing an abdominal exercise to prevent looseness and serve as a fixed headrest for other exercises.

24 Claims, 6 Drawing Sheets

ABDOMINAL EXERCISE STATION

BACKGROUND OF THE INVENTION

1. Field of the Invention

This invention relates to the field of exercise equipment and, more particularly, to an abdominal exercise station for a multi-station exercise apparatus.

2. Background

Increasing recognition of the benefits of exercise has lead to a proliferation of exercise devices for exercising the various muscle groups of the body. Devices for exercising the abdominal muscle groups have become particularly popular not only for reasons of health, but also to achieve a more attractive physical appearance. One example of a prior art device for exercising abdominal muscles is shown in U.S. Pat. No. 4,372,553. In this device, the user is seated in an upright position and performs an abdominal "crunch" exercise that is resisted by a selected amount of weight acting upon a shoulder harness worn by the user.

SUMMARY OF THE INVENTION

The present invention provides a multi-station exercise apparatus with a station for performing abdominal exercises. The abdominal exercise station is combined with another exercise station, such as a press exercise station, a high pulley station or a leg extension/leg curl station. The apparatus for performing an abdominal exercise comprises a pad for the head and/or neck of the exerciser that is pivotally connected to the frame of the exercise machine. A pair of hand grips are connected to the head/neck pad and disposed so that the exerciser may grasp the hand grips in order to pull forward in a "crunch" exercise. Exercise resistance is provided by means such as a weight stack that is shared by the various stations of the exercise machine. The head/neck pad may be "docked" when not performing an abdominal exercise to serve as a fixed headrest for other exercises.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
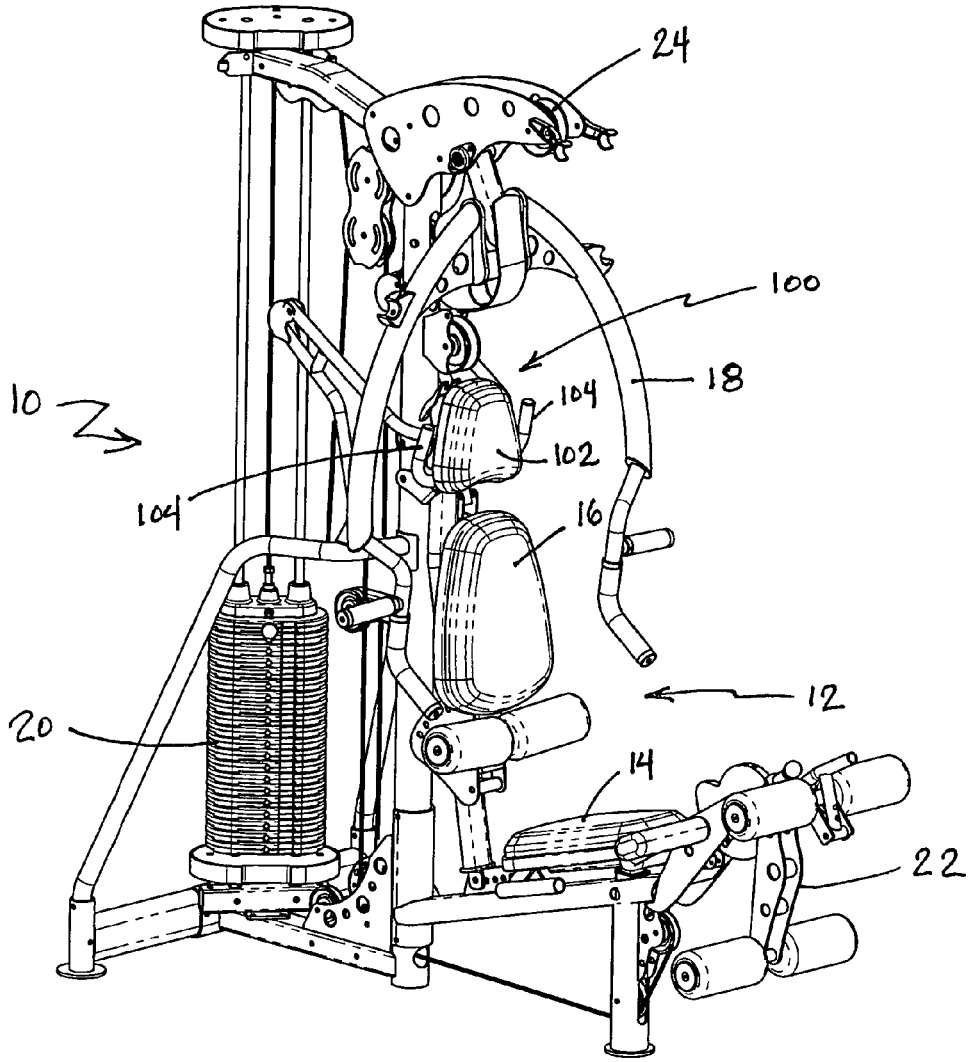
FIG. 1 is a prospective view of a multi-station exercise machine incorporating the present invention.

FIG. 1 is a perspective view of an exercise machine 10 incorporating one embodiment of the present invention. In many respects, machine 10 is a typical multi-station exercise apparatus with which a plurality of exercises may be performed. From seat 12, comprising seat cushion 14 and back cushion 16, an exerciser may perform press exercises using press arm 18, leg extension and leg curl exercises using leg exercise arm 22 and upper body exercises using high pulley 24. As is conventional for multi-station exercise machines, a selectorized weight stack 20 provides exercise resistance for all of the exercises via a system of cables and pulleys. The present invention is not limited to use with this type of exercise machine and may be utilized in machines of other designs and, particularly, machines with alternative means for providing exercise resistance as are well known within the art.

Figure 2:
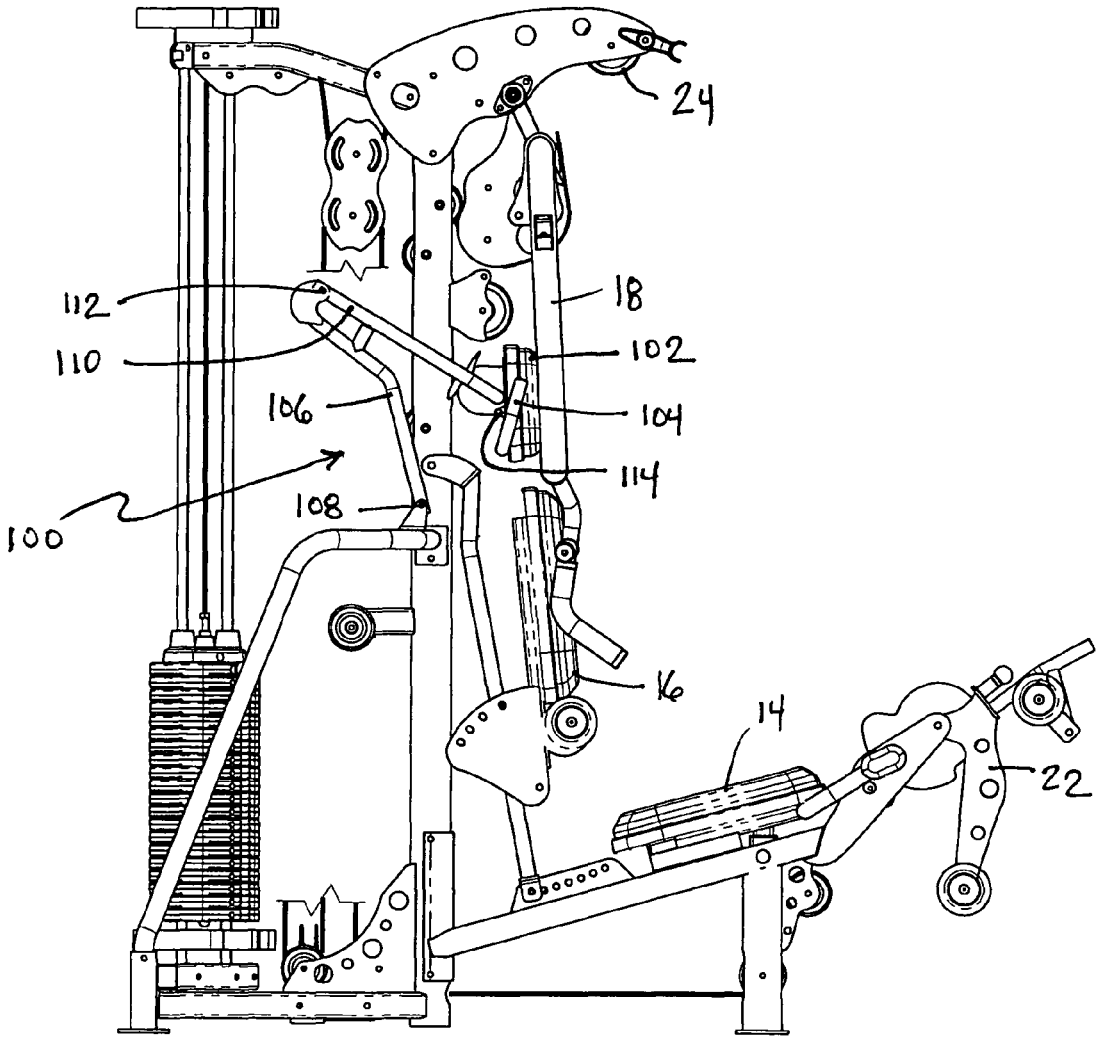
FIG. 2 is a side elevation view of the exercise machine of FIG. 1.

With additional reference to FIG. 2, an exerciser may also perform an abdominal crunch exercise utilizing apparatus 100. A pad 102 for the head and/or neck of the exerciser is positioned above the back cushion 16. Cushion 102 is connected to the frame of exercise machine 12 by an articulated linkage comprising arms 106 and 110. Arm 106 is connected to the frame of the exercise machine at pivot 108 and arm 110, in turn, is connected to arm 106 at pivot 112. Pad 102 pivots at the end of arm 110 on pivot 114. Thus, it can be seen that the articulated linkage comprises three independent pivots. The operation of the articulated linkage will be more fully described below. A pair of hand grips 104 are disposed on opposite sides of pad 102. The hand grips are positioned so that they may be grasped by the exerciser while seated in seat 12.

Figure 3:
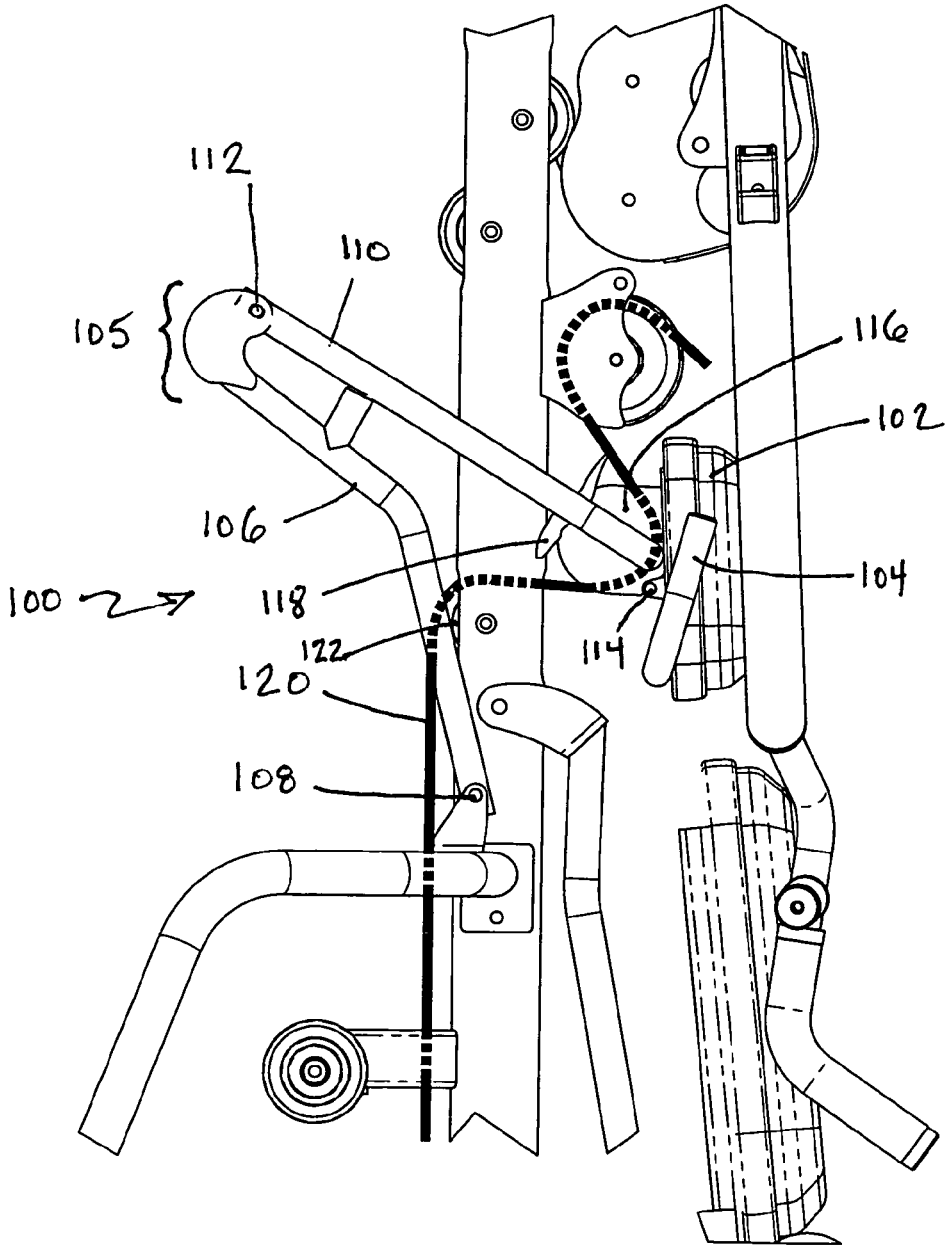
FIG. 3 is a detailed view of the cable routing for operation of an abdominal exercise station.
Figure 4:
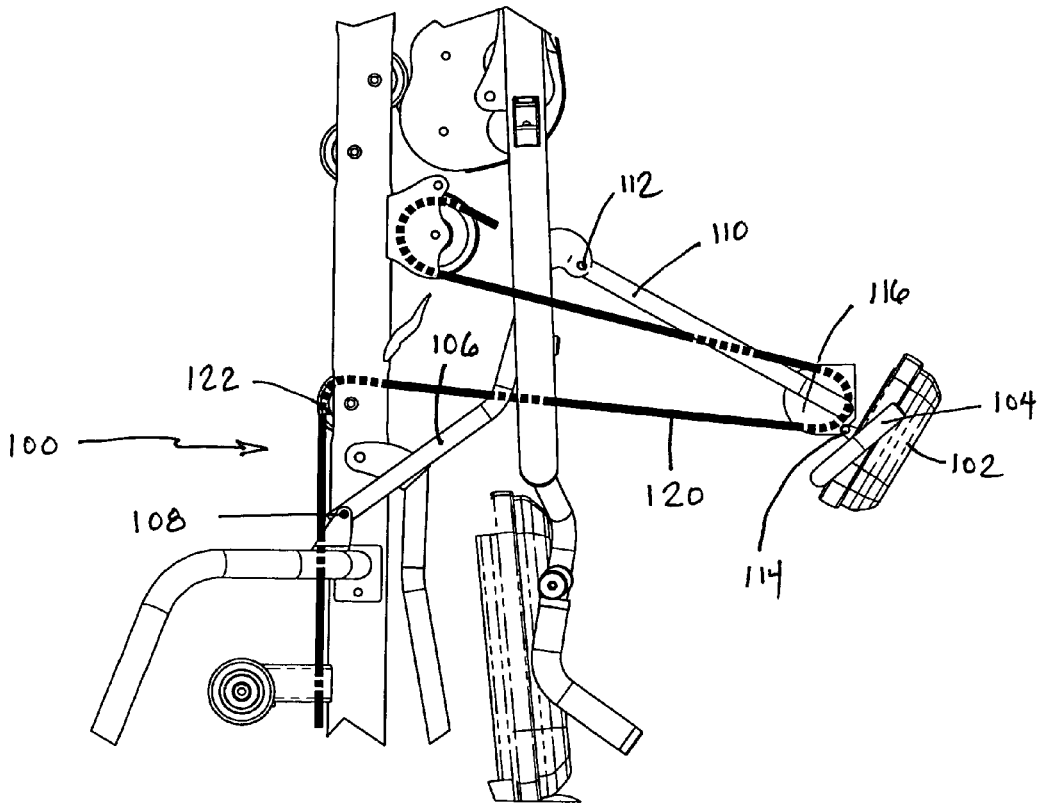
FIG. 4 is a detailed view of the cable routing with the abdominal exercise apparatus extended.

The operation of abdominal crunch exercise apparatus 100 can be seen more clearly in FIGS. 3 and 4. As previously explained, head/neck pad 102 is connected to the frame of the exercise machine by an articulated linkage assembly 105 comprising arms 106 and 110. When not being used to perform an abdominal crunch exercise, pad 102 is "docked" by hooking pulley cover 116 into bracket 118. Pad 102 thus serves as a fixed headrest for other exercises performed while seated on the exercise machine. Cable 120, which is loaded by the exercise machine weight stack, is routed around a pulley (hidden by housing 116) attached to arm 110. Alternatively, the cable could be attached directly to arm 110 or to pad 102.

When the exerciser performs an abdominal crunch exercise, head/neck pad 102 is first "undocked" by lifting slightly up and forward with using hand grips 104. The exercise progresses by continuing to pull forward on the hand grips. Arm 106 pivots about pivot 108, arm 110 pivots about pivot 112 and head/neck pad 102 pivots about pivot 114. Cable 120 is drawn out by the pulley within housing 116, which raises the selected quantity of weights on the weight stack. As the head/neck pad extends forwardly and downwardly during the course of the exercise, cable 120 defines a decreasing (more acute) angle around pulley 122. This cable deflection causes the effective resistance to increase through the course of the exercise.

Figure 5:
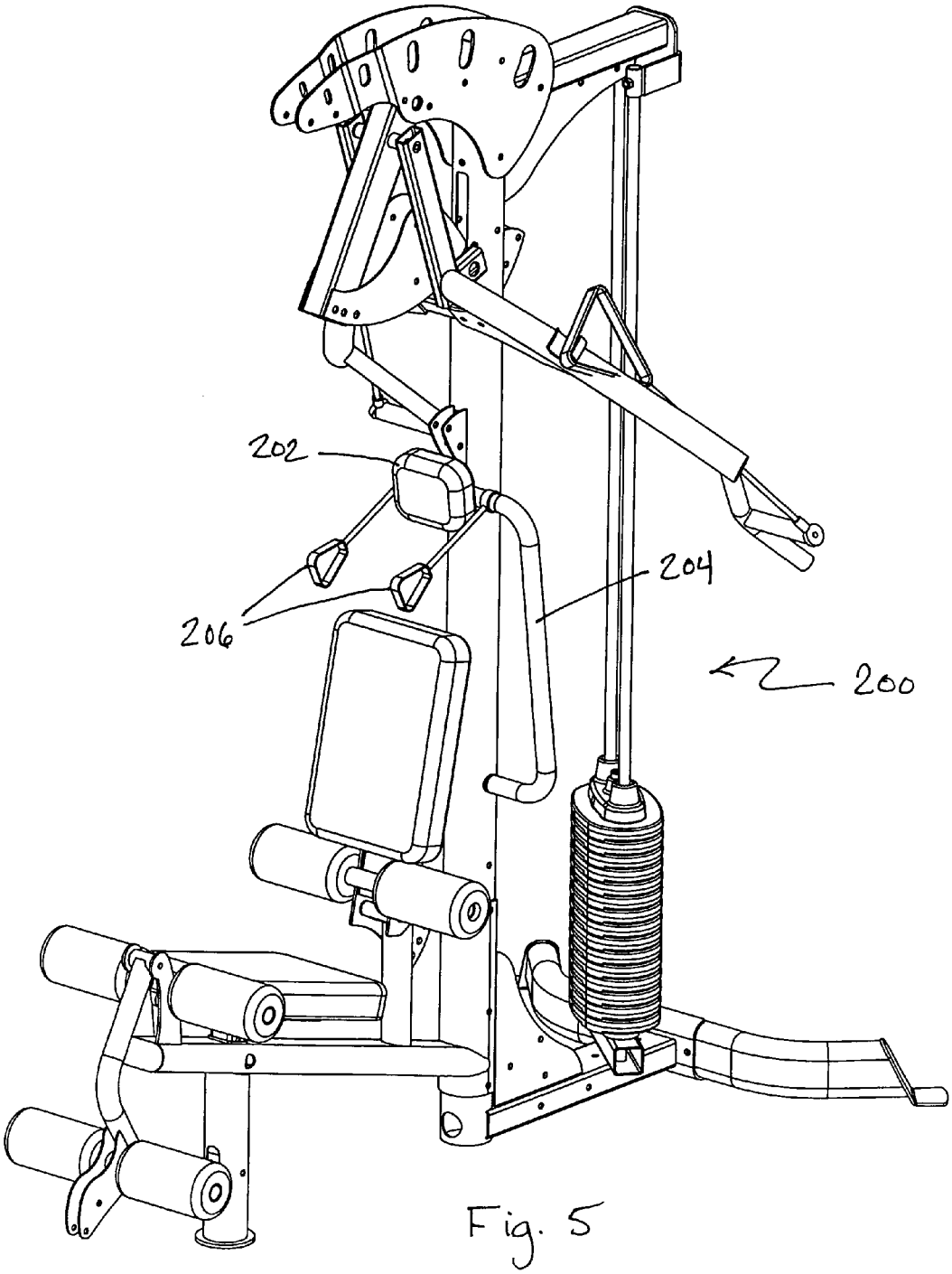
FIG. 5 is a perspective view of a multi-station exercise machine incorporating an alternative embodiment of the present invention.
Figure 6:
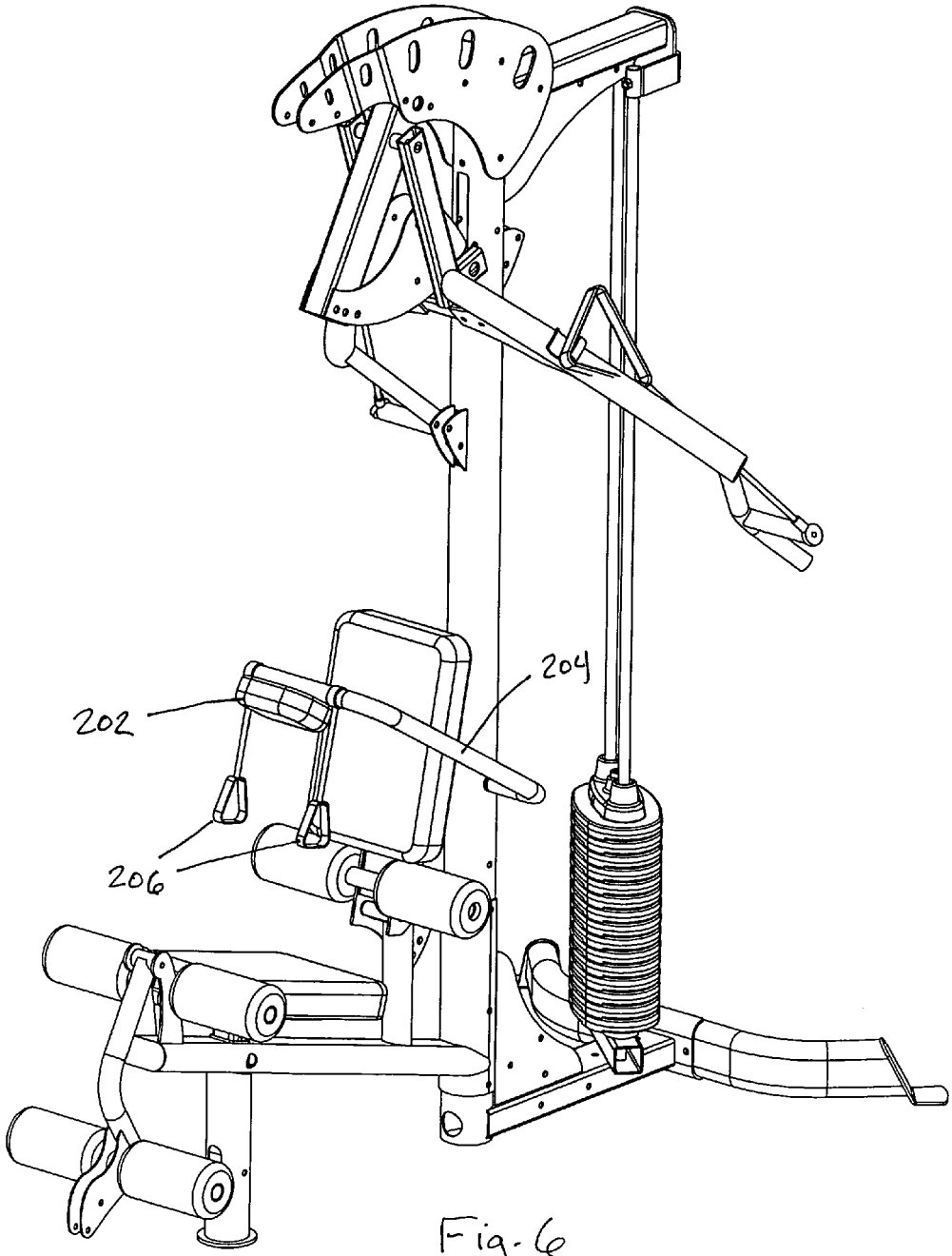
FIG. 6 is a perspective view of the exercise machine of FIG. 5 showing the abdominal exercise apparatus in an extended position.

FIGS. 5 and 6 illustrate a multi-station exercise machine 200 with an alternative embodiment of the present invention. Machine 200 is essentially identical to machine 10 described above, except for the abdominal exercise apparatus 100. In this case, the abdominal exercise apparatus comprises head/neck pad 202 coupled to a single pivot arm 204 in lieu of an articulated assembly. A pair of hand grips 206 are also coupled to the pivot arm 204. Resistance for abdominal crunch exercises may be provided by a cable and pulley coupled to the weight stack as in the previously described embodiment. Alternatively, arm 204 may be pivotally coupled to the frame of the exercise machine with an adjustable friction device or other suitable means for resisting pivotal motion.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus, comprising:
a frame;
a press exercise station;
a seat disposed for operating the press exercise station;
a head/neck pad disposed above the seat;
a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;
adjustable resistance for the press exercise station and the head/neck pad.

2. The exercise apparatus of claim 1 further comprising hand grips connected to the head/neck pad.

3. The exercise apparatus of claim 1 further comprising a high pulley station.

4. The exercise apparatus of claim 1 further comprising a leg extension/leg curl station.

5. The exercise apparatus of claim 1, wherein the pivotal linkage comprises a two-element linkage assembly.

6. The exercise apparatus of claim 5, wherein the pivotal linkage comprises three independent pivots.

7. The exercise apparatus of claim 1, wherein the adjustable resistance is communicated to the head/neck pad by a flexible connecting member.

8. The exercise apparatus of claim 7, wherein the flexible connecting member is guided by a pulley on the pivotal linkage.

9. The exercise apparatus of claim 7, wherein the flexible connecting member is deflected during the course of performing an abdominal crunch exercise so as to vary an effective exercise resistance.

10. The exercise apparatus of claim 1 further comprising a bracket for docking the head/neck pad for use as a fixed pad when using the press exercise station.

11. An exercise apparatus, comprising:
a frame;
a high pulley station;
a seat disposed for operating the high pulley station;
a head/neck pad disposed above the seat;
a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;
adjustable resistance for the high pulley station and the head/neck pad.

12. The exercise apparatus of claim 11 further comprising hand grips connected to the head/neck pad.

13. The exercise apparatus of claim 11 further comprising a press exercise station.

14. The exercise apparatus of claim 11 further comprising a leg extension/leg curl station.

15. The exercise apparatus of claim 11, wherein the pivotal linkage comprises a two-element linkage assembly.

16. The exercise apparatus of claim 15, wherein the pivotal linkage comprises three independent pivots.

17. The exercise apparatus of claim 11, wherein the adjustable resistance is communicated to the head/neck pad by a flexible connecting member.

18. The exercise apparatus of claim 17, wherein the flexible connecting member is guided by a pulley on the pivotal linkage.

19. The exercise apparatus of claim 17, wherein the flexible connecting member is deflected during the course of performing an abdominal crunch exercise so as to vary an effective exercise resistance.

20. The exercise apparatus of claim 11 further comprising a bracket for docking the head/neck pad for use as a fixed pad when using the high pulley station.

21. An exercise apparatus, comprising:
a frame;
a leg extension/leg curl station;
a seat disposed for operating the leg extension/leg curl station;
a head/neck pad disposed above the seat;
a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;
adjustable resistance for the leg extension/leg curl station and the head/neck pad; and
further comprising a press exercise station.

22. An exercise apparatus, comprising:
a frame;
a leg extension/leg curl station;
a seat disposed for operating the leg extension/leg curl station;
a head/neck pad disposed above the seat;
a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;
adjustable resistance for the leg extension/leg curl station and the head/neck pad; and
further comprising a high pulley station.

23. An exercise apparatus, comprising:
a frame;
a leg extension/leg curl station;
a seat disposed for operating the leg extension/leg curl station;
a head/neck pad disposed above the seat;
a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;
adjustable resistance for the leg extension/leg curl station and the head/neck pad, wherein the adjustable resistance is communicated to the head/neck pad by a flexible connecting member; and
wherein the flexible connecting member is guided by a pulley on the pivotal linkage.

24. An exercise apparatus, comprising:
a frame;
a leg extension/leg curl station;
a seat disposed for operating the leg extension/leg curl station;
a head/neck pad disposed above the seat;

a pivotal linkage coupling the head/neck pad to the exercise apparatus, the pivotal linkage comprising at least one linkage arm pivotally connected to the frame, the pivotal linkage configured such that the head/neck pad is usable for performing an abdominal crunch exercise;

adjustable resistance for the leg extension/leg curl station and the head/neck pad; and further comprising a bracket for docking the head/neck pad for use as a fixed pad when using the leg extension/leg curl station.

* * * * *